US006282298B1

(12) United States Patent
Azima et al.

(10) Patent No.: US 6,282,298 B1
(45) Date of Patent: Aug. 28, 2001

(54) ACOUSTIC DEVICE

(75) Inventors: Henry Azima, Cambridge; Martin Colloms, London; Neil Harris, Cambridge, all of (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/389,492

(22) Filed: Sep. 3, 1999

Related U.S. Application Data

(63) Continuation of application No. PCT/GB98/00621, filed on Feb. 27, 1998, and a continuation-in-part of application No. 08/707,012, filed on Sep. 3, 1996.

(30) Foreign Application Priority Data

Mar. 4, 1997 (GB) ..... 9704486

(51) Int. Cl.[7] ..... H04R 25/00
(52) U.S. Cl. ..... 381/423; 381/431; 381/424
(58) Field of Search ..... 381/423, 424, 381/425, 431, 426, FOR 162, FOR 163, 386; 181/157, 163, 164, 166, 173, 174

(56) References Cited

U.S. PATENT DOCUMENTS 3,596,733 * 8/1971 Bertagni ..... 381/431
4,322,583 * 3/1982 Maeda ..... 381/425
4,532,383 * 7/1985 Willy ..... 381/424
5,539,835 * 7/1996 Bertagni et al. ..... 381/423

FOREIGN PATENT DOCUMENTS 2 411 981 6/1980 (FR) .
2 074 812 11/1981 (GB) .
92/03024 2/1992 (WO) .

OTHER PUBLICATIONS

Sato; "Diaphragm for Speaker"; Paten Abstracts of Japan; vol. 14, No. 112, Feb. 28, 1990; Publication No. 01 311795; Publication Date: Dec. 15, 1989.

* cited by examiner

*Primary Examiner*—Sinh Tran
(74) *Attorney, Agent, or Firm*—Foley & Lardner

(57) ABSTRACT

Acoustic devices have members extending transversely of thickness and capable of sustaining bending waves causing consequential acoustic action by reason of areal distribution of resonant modes of natural bending wave vibration consonant with required achievable acoustic action of said member over a desired operative acoustic frequency range. Areal distribution of stiffness including variation(s) therein is used to get desired locations for bending wave transducers and/or good resonant mode acoustic action from inherently unfavorable shapes of members. Members with combined pistonic action drive and bending wave excitement at centers of mass and geometry are featured.

16 Claims, 12 Drawing Sheets

ACOUSTIC DEVICE

This application is a continuation of International application No. PCT/GB98/00621, filed Feb. 27, 1998; and a continuation-in-part of U.S. application Ser. No. 08/707,012, filed Sep. 3, 1996.

FIELD OF THE INVENTION

This invention relates to acoustic devices capable of acoustic action by bending waves and typically (but not exclusively) for use in or as loudspeakers.

BACKGROUND TO THE INVENTION

Our co-pending earlier patent application Ser. No. 08/707,012 includes general teaching as to nature, structure and configuration of acoustic panel members having capability to sustain and propagate input vibrational energy through bending waves in acoustically operative area(s) extending transversely of thickness usually (if not necessarily) to edges of the member(s). Specific teaching includes analyses of various specific panel configurations with or without directional anisotropy of bending stiffness through/across said area(s) so as to have resonant mode vibration components distributed over said area(s) beneficially for acoustic coupling with ambient air; and as to having determinable preferential location(s) within said area(s) for acoustic transducer means, particularly operationally active or moving part(s) thereof effective in relation to acoustic vibrational activity in said area(s) and related signals, usually electrical, corresponding to acoustic content of such vibrational activity. Uses are also envisaged in that earlier patent application for such members as or in "passive" acoustic devices, i.e. without transducer means, such as for reverberation or for acoustic filtering or for acoustically "voicing" a space or room; and as or in "active" acoustic devices with bending wave transducer means, including in a remarkably wide range of loudspeakers as sources of sound when supplied with input signals to be converted to said sound, and also in such as microphones when exposed to sound to be converted into other signals.

Our co-pending U.S. patent application Ser. No. 09/246,967, filed Feb. 9, 1999 concerns using features of mechanical impedance in achieving refinements to geometry and/or location(s) of bending wave transducer means for such panel members as or in acoustic devices. The contents of application Ser. No. 08/707,012 and 09/246,967 are hereby incorporated herein to any extent that may be useful in or to explaining, understanding or defining the present invention. These applications are collectively referred to herein as the "two prior patent applications."

This invention arises particularly in relation to active acoustic devices in the form of loudspeakers using panel members to perform generally as above (and as may be called distributed mode acoustic radiators/resonant panels later herein), but further particularly achieve satisfactory combination of pistonic action with bending wave action. However, more general or wider aspects of invention arise, as will become apparent.

SUMMARY OF THE INVENTION

From a first viewpoint, this invention concerns active acoustic devices relying on bending wave action in panel members, particularly providing effective placement(s) for bending wave transducer means different from specific teachings of the two prior patent applications, i.e. other than at location(s) arising from analysis and preference in that parent application Ser. No. 08/707,012, even including at centre(s) of mass and/or geometry rather than off-set therefrom.

From a second viewpoint, this invention concerns acoustic devices relying on bending wave action in panel members, particularly providing effective distributions of resonant mode vibration that may be different from what results from specific teachings and preferences of the two prior patent applications even for the same configurations or geometries.

From a third viewpoint, this invention concerns acoustic devices relying on bending wave action in panel members, particularly providing effective distributions of resonant mode vibration in panel members of different configurations or geometries from what are regarded as inherently favourable in specific teachings and preferences of the two prior patent applications.

It is considered useful to note that effective specific embodiments of this invention utilise panel member(s) intrinsically affording areal distribution of resonant mode vibration components effective for acoustic performance generally comparable or akin to the two prior patent applications, essentially, relying on simple excitement of such intrinsically a really distributed acoustic bending wave action for successful acoustic operation; rather than in any way resembling merely piece-meal provisions for altering intendedly other acoustic action in panel member(s) for which such intrinsic distributed resonant mode action is not even a design requirement indeed, usually where other particular structural etc provisions are made to serve different frequency ranges and/or selectively suppress or specifically produce/superpose vibrations in a panel member that is not intrinsically effective as in two prior patent applications or herein, typically being inherently unsuitable as a matter of geometry and/or location of transducer means.

Effective inventive method and means hereof involve areal distribution of variation in stiffness over at least area(s) of such panel member(s) that are acoustically active in relation to bending wave action and desired acoustic operation. As will become clear herein, such variation can usefully be directly related effectively to displacement of transducer means from locations as specifically taught in the two prior patent applications to different locations of this invention, and/or, relative to such patent applications, to rendering unfavourable configurations or geometries of panel members more akin to favourable configurations or geometries for acoustic operation involving areal distribution of resonant modes of vibration consequential to bending wave action, and/or with actual resonant mode distribution that may be at least somewhat different, whether due simply to different areal distribution of bending stiffness hereof or to consequential different location(s) for transducer means, or both.

Specific teaching of parent application Ser. No. 08/707,012 extends to panel member(s) having different bending stiffness(es) in different directions across intendedly acoustically active area(s) that may be all or less than all of area(s) of the panel member(s), typically in or resolvable to two coordinate related directions, and substantially constant therealong. In contrast, advantageous panel member(s) of embodiment(s) hereof have variation of bending stiffness (es) along some direction(s) across said area(s) that is/are irresolvable to constancy in normal coordinate or any direction(s).

Areal variation of bending stiffness is, of course, readily achieved by variation of thickness of acoustic panel members, but other possibilities arise, say concerning thickness and/or density and/or tensile strength of skins of sandwich-type structures and/or reinforcements of monolithic structures usually of composite material(s) type.

Whilst available practical analysis may not always allow such investigation as precisely and fully to identify and quantify changes in actual areal distribution of acoustically effective resonant mode vibration for panel member(s) hereof—even where having substantially similar geometry and/or average stiffnesses in relevant directions as for specific isotropic or anisotropic embodiments per parent application Ser. No. 08/707,012—practical resulting performance indicates little if any significant diminishing or degradation in achieved successful acoustic performance involving bending wave action, indeed encourages belief in potential even for improving same. Beneficial effects (on areal distribution of resonant mode vibration), of basically favourable configuration/geometry of the tow prior patent applications can, however, be substantially retained to very useful extent and effect in two groups or strands of inventive aspects implementing above one viewpoint.

One group/strand is as already foreshadowed, specifically providing more convenient location(s) for transducer means in acoustically active panel members or areas thereof having configurations or geometries known to be favourable in isotropic or anisotropic implementations of teachings of two prior patent applications, effectively by displacing what are now called "natural" locations for transducer means (in accordance with these patent applications), to different locations hereof, specifically by either or both of relatively greater and lesser bending stiffnesses to one side and to the other side, respectively, of such natural location(s). Region (s) of greater bending stiffness serve(s) effectively to shift such natural location(s) away from such region(s), typically from said one side towards said other side and region(s) of lesser bending stiffness; region(s) of lesser bending stiffness serving to shift towards own region(s). The other group/strand can be viewed as involving capability only partially to so define same at least notional sub-geometry of larger overall panel member geometry not specifically favourable to good distributed mode acoustic operation as in the two prior patent applications; such sub-geometry being incompletely circumscribed and not necessarily specifically so favourable of itself but the partial definition thereof having significant improving effect on distributed mode acoustic operation, say tending towards a type of configuration or geometry known to include specific favourable ones if not at least approaching such favourable ones; such improving effect being particularly for distributing resonant modes therefor at lower frequencies, but not necessarily (indeed preferentially not) limiting higher frequency bending wave action and resonant mode distribution to such sub-geometry, i.e. allowing such higher frequency resonant mode distribution of vibration past and beyond the partial sub-geometry definition.

As to readily achieving required or desired areal variation of bending stiffness panel member(s) can have at least core layer(s) first made as substantially uniformly isotropic or anisotropic structure(s), say as used for two prior patent applications, including sandwich structure(s) having skin layers over core layer(s). Variation(s) of thickness can then be readily imposed to achieve desired areal distribution of stiffness(es). For deformable material(s), such as foam(s), such variation of thickness is achievable by selective compression or crushing to achieve desired contouring, say by controlled heating and application of pressure, typically to any desired profile and feasibly done even after application of any skin layers (depending on stretch capability of such skin layer material). Another possibility is for the member to have localised stiffening or weakening, perhaps preferably graded series thereof. For through-cell or honeycomb materials, e.g. of some suitable reticulated section of its cells extending from skin to skin of an ultimate sandwich structure, or rigidly form-sustaining uncrushable composites, variation of thickness is readily achievable by selective skimming to desired thickness contouring/profiling. None of these possibilities involves necessary change of geometrical centre, but skimming rather than crushing inevitably results in change of centre of mass. Further alternatives for desired thickness/stiffness variation of as-made core(s) will be discussed, including without change of centre of mass as can be important for transducer means combining pistonic and bending wave actions, where pistonic action is manifestly best if centred at coincidence of centre of mass and geometric centre to avoid differential moments due to mass distribution relative to transducer location(s) and/or to unbalanced air pressure effects.

Centre of mass is, of course, readily relocated, typically to geometric centre, by selective addition of mass(es) to panel member(s) concerned, preferably without unacceptable effects on desired areal distribution of stiffness, e.g. masses also small enough not unacceptably to affect lower frequency bending wave action and effectively decoupled from higher frequency acoustic action(s), say small weight(s) suitably semi-compliantly mounted in hole(s) in the panel also small enough not unacceptably to affect acoustic action (s).

Increasing stiffness in one direction away from or to one side of the 'natural' location(s) for transducer means location(s) of the two prior patent applications, or decreasing stiffness in a generally opposite direction or to other side, will result in transducer means location(s) hereof generally in said one direction to said one side, which can advantageously be towards geometric centre. Such relative increasing/decreasing of stiffness can be complex as to resulting contouring of the panel member concerning, including tapering down increased thickness/stiffness to edge of the panel member and or sloping up decreased thickness/stiffness, say to have a substantially uniform edge thickness of the panel member.

Additionally or alternatively, an inventive aspect of at least the one group/strand is seen in a panel member capable of acoustic bending wave action with a distribution of bending stiffness(es) over its acoustically active area that is in no sense centred coincidentally with centre of mass and/or geometrical centre of that panel member, though location(s) of acoustic transducer means, whether for bending wave action or for pistonic action or for both, may be substantially so coincident, often and beneficially so.

It is noted at this point that there are two ways in which areal distributions of stiffness(es) over a panel member can be considered or treated as centred, one analogous to how centre of mass is usually determined, i.e. as putting first moment of stiffness to zero, thus in a sense corresponding to high stiffness (so herein called "high centre" of stiffness); the other in an inverse manner, putting first moment of the reciprocal of stiffness to zero, thus in another sense corresponding to weakness or low stiffness (so herein called "low centre" of stiffness). In panel members with isotropy or anisotropy as specifically analysed in parent application Ser, No. 08/707,012 , these notional "high" and "low" centres of stiffness (so far as meaningful in that context) are actually coincident, further normally also coinciding with centre of mass and with geometrical centre; but, for a panel member with stiffness distribution as herein, these notional "high" and "low" centres of stiffness are characteristically spaced apart and typically further also from centre of mass and/or geometric centre.

Reverting to effective or notional shifting (by beneficial distributions of stiffness(es) hereof) of practically effective location(s) for bending wave action transducer means (from location(s) afforded by preferred teachings/analyses of the two prior patent applications to different location(s) hereof), such shifting can usefully be viewed as towards said "low centre" of stiffness which should thus be along same direction as desired notional shifting, and/or away from said "high centre" of stiffness that may usefully afford at least a structural design reference position for providing variations of bending stiffness(es) in the desired/required corresponding distribution thereof. Variation of bending stiffness outwards from such "low centre(s)" to edge(s) of panel member (s) concerned, typically with stiffness(es) increasing to different amounts and/or at different rates in plural directions at least towards "high centre(s)".

Feasible structures of honeycomb cellular cored sandwich type can have desired stiffness distribution by reason of contributions of as-made variant individual cell geometries, and without necessarily substantial effect(s) on distribution and centre of mass. Thus, desired areal distributions of stiffness(es) are achievable by variations of cells as to any or all of cell sectional area (if not also shape), cell height (effectively core thickness) and cell wall thickness, including with such degree of progressiveness applied to increase/decrease as may be desired/required. Varying bending stiffness(es) without disturbing distribution of mass is achievable in such context, say by varying cell wall thickness and cell height for nominally same cell area, and/or by varying cell area and/or cell height for same thickness of cell walls, and could, of course, be augmented or otherwise affected by skin variations, including varying number and/or nature of ply layers.

Also, it is seen as inventive for panel members hereof to have at least "low" centres of stiffness(es) and practically most effective drive location(s) that are identified and typified oppositely in terms of minimum and maximum diversity of transit times to panel edge(s) for notional or actual bending waves considered as started from "low centre" of stiffness and from transducer location(s), respectively.

Reverting to above second general view, panel members with distribution(s) of stiffness(es) as herein (as might perhaps be called "eccentric") can have capability applicable to securing that a said panel of some particular given or desired shape (i.e. configuration or geometry) may exhibit practically effective acoustic bending wave action that was not considered achievable hitherto for that particular shape, at least not according to any prior helpful proposition; including not only for unfavourable shapes related to known favourable shapes, but for shapes not so related but treatable as herein to at least approach what would hitherto be characteristic of some particular favourable shape.

Indeed, this invention extends to capability of some physically realisable areal distribution of bending stiffness (es) of and for even irregularly shaped panel members capable of bending wave acoustic action, to render such action of satisfactorily distributed resonant mode characteristic, and to afford practically effective location(s) for bending wave action transducer means (including by finite element analysis), even irrespective of and without reference to any envisaged or target shape known to be favourable. Such procedures might proceed to at least some extent pragmatically, by trial and error, as to areal stiffness distributions, but can be helped by analysing same using such as Finite Element Analysis at least in terms of affording useful "low" and "high" centres of stiffness shown herein to have positive (approaching/attracting) and negative (distancing/repelling) location effects on effective location (s) for transducer means within such areal stiffness distribution, whether itself analysable or not.

In practice, useful benefits are seen by way of seeking out constructs and/or transforms by which derivation(s) can be made from what is known to be effective for particular panel member geometries and structures to what may, often will, be effective for a different panel geometry/structure, particularly to indicate structural specification for such different panel geometry as to likely successful areal stiffness distribution and as to transducer drive location(s).

In one approach considered inventive herein, useful attention has been concentrated on transducer location(s), including by way of notionally superposing as a target geometry a desired or given configuration of panel member and a subject geometry of a panel member that is known to be effective and for which detailed analysis is readily done or available, so that desired target transducer location coincides with actual preferentially effective transducer location of the subject geometry. Then, a bending stiffness mapping can be made so that, for any or each of selected constructs relative to now-coincident transducer locations of the target and subject geometries, and over such geometries, so that the known/readily analysed bending stiffness of the subject panel structure can be subject to transformation relative to the target geometry to give substantially the same or similar or scaled comparable stiffness distribution as in the subject geometry and acoustically successful bending wave action in the target geometry. Promising such constructs include lines going from coincident transducer locations to/through edges of the target and subject geometries (say as though representing bending wave transits/traverses). Envisaged related transforms depend on relative lengths of the same construct lines in the target and subject geometries, and a suitable relationship, typically involving the quotient of bending stiffness (B) and mass per unit area ($\mu$), i.e. $B/\mu$, for proportionality transforms involving the third and/or fourth powers of such line lengths to edges of target and subject geometries. It is preferred, at least as feeling more natural, for a target geometry to be smaller than a related subject geometry, further preferable for superposition to seek to minimise excess of the latter over the former, including to minimise transform processing. Whilst generally similar types of target and subject shapes may thus be preferred, or favourable subject geometry closest to unfavourable target geometry, it is seen as feasible for the target geometry to differ quite substantially from any recognisable type of known favourable configuration/structure.

It is the case that panels of the parent application No. 08/707,012 that are isometric as to areal bending stiffness, and well studied/analysed, are good starting points for subject geometries/structures. Indeed, another construct/transform approach seen as having potential involves seeking to match in the target geometry/structure according to the way that the (now common) transducer location splits bending stiffnesses to each side thereof in the subject geometry/structure. Moreover, similar or related mapping schemes could be used not only as between differing geometry types, but also in the event of wishing or requiring to give to a target geometry of one type such a bending stiffness distribution as to resemble or mimic another type of geometry/configuration, so far as practicable given type of geometry/configuration (e.g. rectangular, elliptical) does have profound influence on actual areal distribution of resonant mode vibration that can be difficult to disturb greatly.

For loudspeaker members capable of both pistonic and bending wave types of action, coincidence of location of bending wave transducer means with centre of mass and geometric centre is particularly effective in allowing a single transducer device at one location to combine and perform both pistonic drive and bending wave excitation.

It is, however, feasible to use separate transducers one for pistonic-only action at coincident centre of mass/geometric centre, and another for spaced location conveniently located as herein for bending wave-only action, though mass balancing may then be required by added masses (if not afforded conjointly with requisite distribution of bending stiffness).

A particularly interesting aspect of invention, concerning a single transducer that affords both of pistonic action and spaced bending wave action but at spaced positions, can be used whether spacing is achieved by bending wave transducer location as herein (say to suit convenient transducer configuration) or left as arises without application of above aspects of invention.

Generally, of course, application of this invention may involve distributions of mass with centre of mass displaced from geometric centre and/or any transducer location, or whatever. Indeed, variation(s) of bending stiffness and/or mass across at least acoustically operative area(s) of panel member(s) can be in many prescribed ways and/or distributions, usually progressively in any particular direction to desired ends different from hitherto, and same will generally represent anisotropy that is asymmetric at least relative to geometric centre of mass; and application is seen as in parent application Ser. No. 08/707.012.

Practical aspects of invention include a loudspeaker drive unit comprising a chassis, a transducer supported on the chassis, a stiff lightweight panel diaphragm drivingly coupled to the transducer, and a resilient edge suspension surrounding the diaphragm and mounting the diaphragm in the chassis, wherein the transducer is arranged to drive the diaphragm pistonically at relatively low audio frequencies to produce an audio output and to vibrate the diaphragm in bending wave action at higher audio frequencies to cause the diaphragm to resonate to produce an audio output, the arrangement being such that the transducer is coupled to the centre of mass and/or geometric centre of the diaphragm and the diaphragm has a distribution of bending stiffness including variation such that acoustically effective resonant behaviour of the diaphragm results (at least preferably being centred offset from the centre of mass).

The diaphragm may be circular or elliptical in shape and the transducer may be coupled to the geometric centre of the diaphragm. The diaphragm may comprise a lightweight cellular core sandwiched between opposed skins, and one of the skins may be extended beyond an edge of the diaphragm, with a marginal portion of the extended skin being attached to the resilient suspension.

The transducer may be electromagnetic and may comprise a moving coil mounted on a coil former, the coil former being drivingly connected to the diaphragm. A second resilient suspension may be connected between the coil former and the chassis. One end of the coil former may be connected to the diaphragm, and the said second resilient suspension may be disposed adjacent to the said one end of the coil former, and a third resilient suspension may be connected between the other end of the coil former and the chassis.

The end of the coil former adjacent to the panel diaphragm may be coupled to drive the panel diaphragm substantially at one point. Conical means may be connected between the coil former and the panel diaphragm for this purpose.

The coil former may comprise a compliant section radially offset from a rigid section to drive the diaphragm pistonically and to provide off centre resonant drive to the diaphragm.

In other aspects the invention provides a loudspeaker comprising a drive unit as described above; and/or is a stiff lightweight panel loudspeaker drive unit diaphragm adapted to be driven pistonically and to be vibrated to resonate, the diaphragm having a centre of mass located at its geometric centre and a centre of stiffness which is offset from its centre of mass.

BRIEF DESCRIPTION OF THE DRAWINGS

Exemplary specific implementation is now illustrated/described in/with reference to accompanying diagrammatic drawings, in which.

SPECIFIC DESCRIPTION OF EMBODIMENTS

Figure 1A:
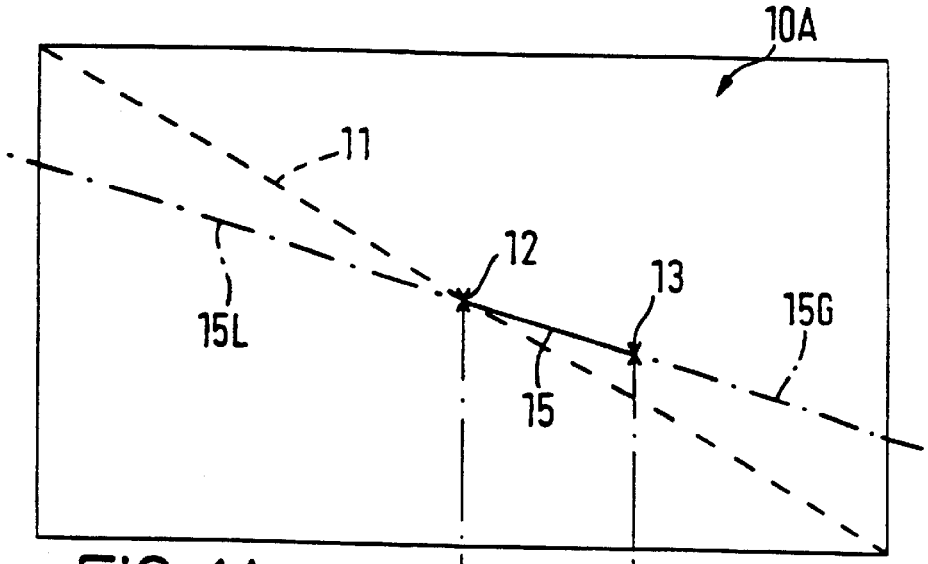
FIGS. 1A–D are plan and three outline sectional views indicating desired positioning of bending wave transducer location of an acoustic panel member, including and achievement by compressing deformable core material or by profiling core or composite material.

Referring first to FIG. 1A, a substantially rectangular acoustic distributed mode panel member 10A is indicated as though resulting directly from teachings of the two prior patent applications, thus having its "natural" location 13 for bending wave transducer means spaced from its geometrical centre 12 and off true diagonal shown dashed at 11. In application of the present invention, however, the transducer location 13 is to be at the geometric centre 12 of the panel member 10A, i.e. effectively to appear shifted along the solid line 15, which is achieved by appropriate areal distribution of bending stiffness of the panel member. To this end, the bending stiffness is made relatively greater and lesser to one side (right in FIG. 1A) and to the opposite side (left in FIG. 1C) of the geometric centre 12 and the "natural" transducer location 13, specifically in opposite directions along the line 15 and its straight-line extensions 15G and 15L, respectively.

Figure 1B:
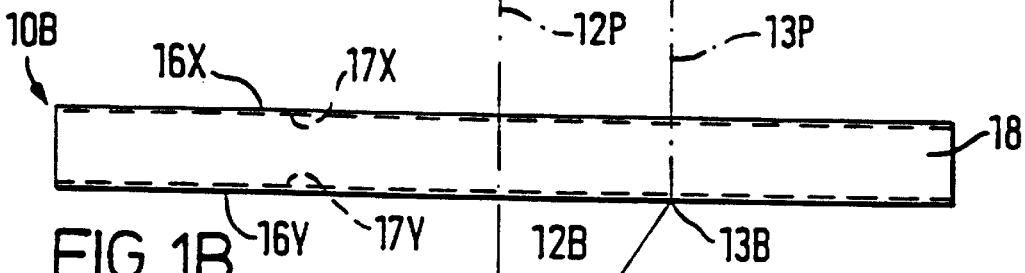

FIG. 1B is an outline section along the line 15 including extensions 15G and 15L, and indicates the same situation as FIG. 1A, i.e. "natural" transducer location 13B likewise spaced from geometric centre 12B of distributed mode panel member 10B, see projection lines 12P, 13P. FIG. 1B gives no details for the actual structure of the panel member 10B; but does indicate the alternatives of being monolithic, see solid outer face lines 16X, Y, or being of sandwich type, see dashed inner face lines 17X, Y indicating skins bonded to an inner core 18, typically (though not necessarily) of cellular foam type or of honey-comb through-cell type.

Figure 1C:
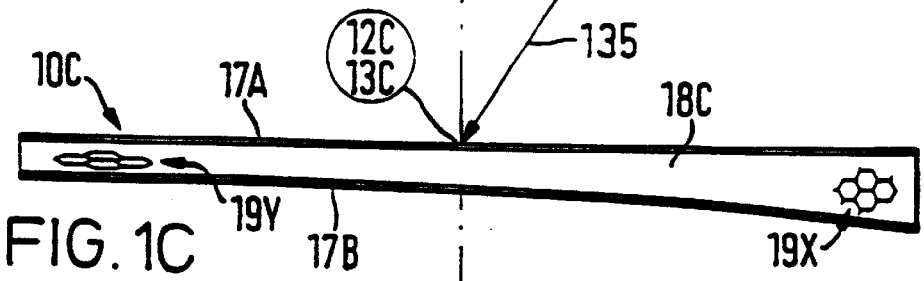

FIG. 1C indicates use of a core 18C of material that is deformable, specifically compressible in being capable of crushing to a lesser thickness, as is typically of many foamed cellular materials suitable for distributed mode acoustic panel members and assumed in FIG. 1C. Such crushing is indicated by thickness of the core 18C diminishing from right to left in FIG. 1C, and its cells going from roundedly fully open (19X) to flattened (19Y). It is not, of course, essential for those cells to be of the same or similar size, or of regular arrangement, or be roundedly fully open at maximum thickness (suitable foam materials often being of partially compressed foamed type). The core 18C is further shown with facing skins 17A, B. It is feasible, even normal, for the core material 18C to be deformed to the desired profile before bonding-on the skins 17A, B—but not essential so long as the panel member 10C is good for distributed mode acoustic action if compressively deformed with the skins 17A, B attached. Resulting greater and lesser thickness of the core 18C and the panel member 10C will correspond with greater and lesser bending stiffness; and the indicated profile of progressive thickness, thus stiffness, variation is such as to cause coincidence of the transducer location 13C with the geometric centre 12C, see arrow 13S and circled combined reference 12C, 13C. Crushing deformation will normally be done with thermal assistance and using a suitably profiled pressure plate. There will be no change to the centre of mass of the panel member 10C, i.e. centre of mass will remain coincident with the geometric centre 12C, now also coincident with the transducer location 13C.

Where core density contribution is small, ie bending stiffness is dominant, the linear factor of core mass contribution may be neglected and the desired areal thickness distribution may be achieved by shaping the thickness of an isotropic core of polymer foam or fabricated honeycomb sandwich or monolithic without skin and a core; and any such structure can be fabricated, machined or moulded as desired herein.

Figure 1D:
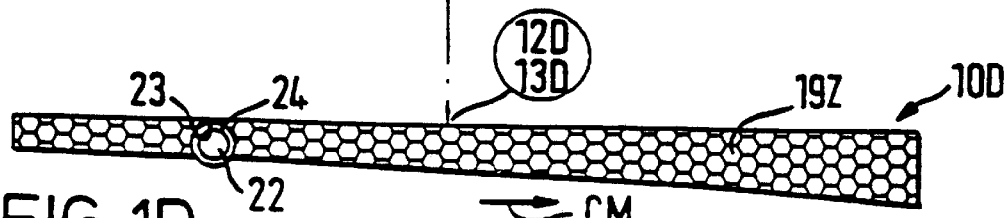

FIG. 1D shows distributed mode acoustic panel member 10D with progressive relief of its lower surface so that its thickness reduces with similar profile to that of FIG. 1C. Such profile might be somewhat different for the same intended effect, i.e. achieving coincidence of transducer location 13D with geometric centre 12D, say depending on material(s) used for the panel member 10D. Such materials may be monolithic reinforced composites or any kind of cellular, typically then as a skinned core, including of honey-comb type with through-cells extending from skin-to-skin. The foamed-cell-like indication 19Z of FIG. 1D could correspond with use of foamed material that is by choice not crushed or is not suitable for crushing; but is intended to do no more than indicate that there is no significant change of density. There must, of course, then be a change in the distribution of mass and the centre of mass of the panel member 10D as such will be spaced from the geometric centre, generally in the direction of arrow CM. In order to achieve coincidence of overall centre of mass with geometric centre 12D, the panel member 10D is shown with at least one additional balancing mass 22 indicated mounted in preferably blind receiving hole 23, further preferably by semi-compliant means 24, say in a suitable mechanically or adhesively secured bush or sleeve, so that its inertial compress is progressively decoupled from the panel member 10D at higher frequencies of desired vibration distribution. There may be more than one balancing mass (22), say in a less than 180° locus through the notional extension line 15L, or some other array disposition, and need not all be of the same mass, say diminishing in mass progressively away from the line 15L.

At simplest, the thickness may be simply tapered along through the section of FIG. 1B, though a more complex taper is normal, including to a common equal edge thickness and/or progressively less away from the line 15–15G, L. Geometric relations of bending frequency to size are used need to be taken into account. For any given shape, increasing its size lowers the fundamental frequencies of vibration, and vice versa. Effective shift of preferential transducer location can be seen as equivalent to shortening the effective panel size in relation bending along the direction of such shift.

Figure 2A:
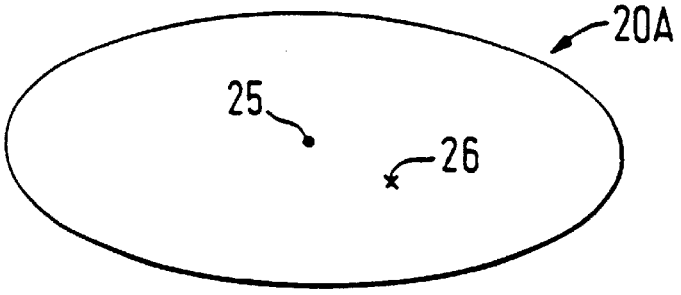
FIGS. 2A, B, C are outline overall plan view and core sectional views for an elliptical acoustic panel member hereof.
Figure 2B:
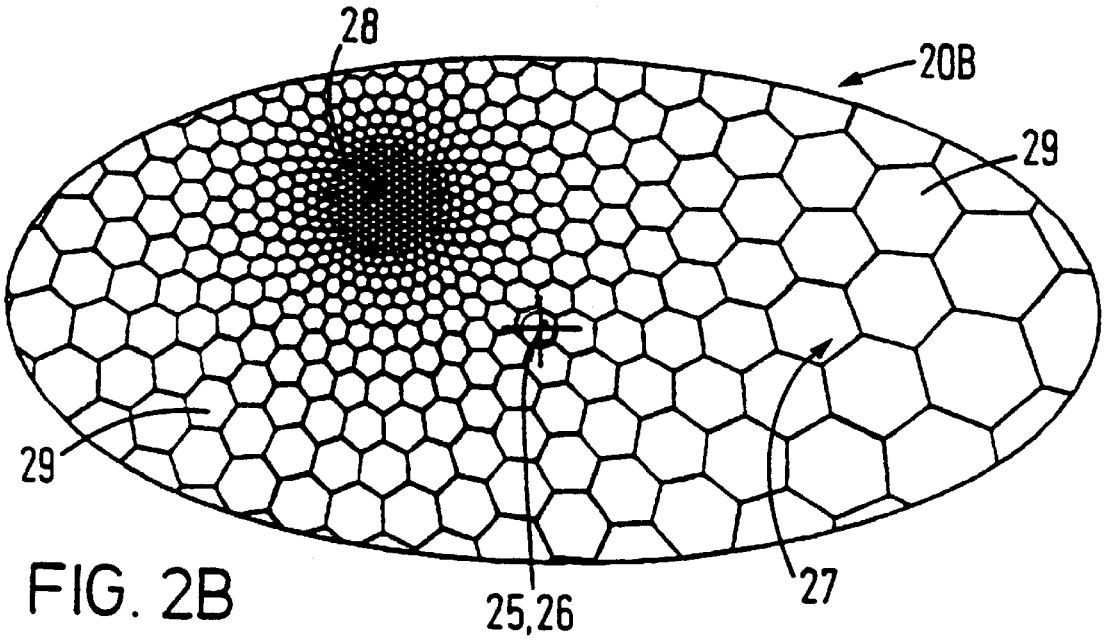
Figure 2C:
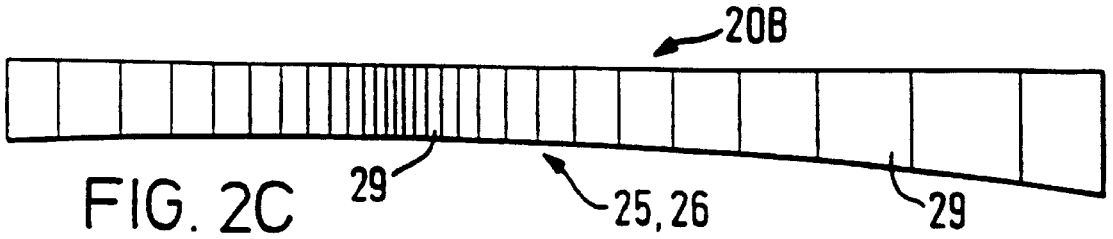
Figure 3A:
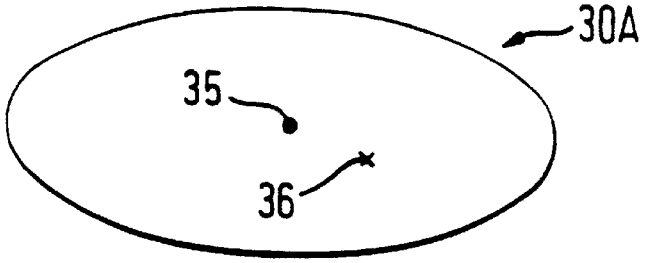
FIGS. 3A, B, C are similar views of another elliptical panel member hereof.
Figure 3B:
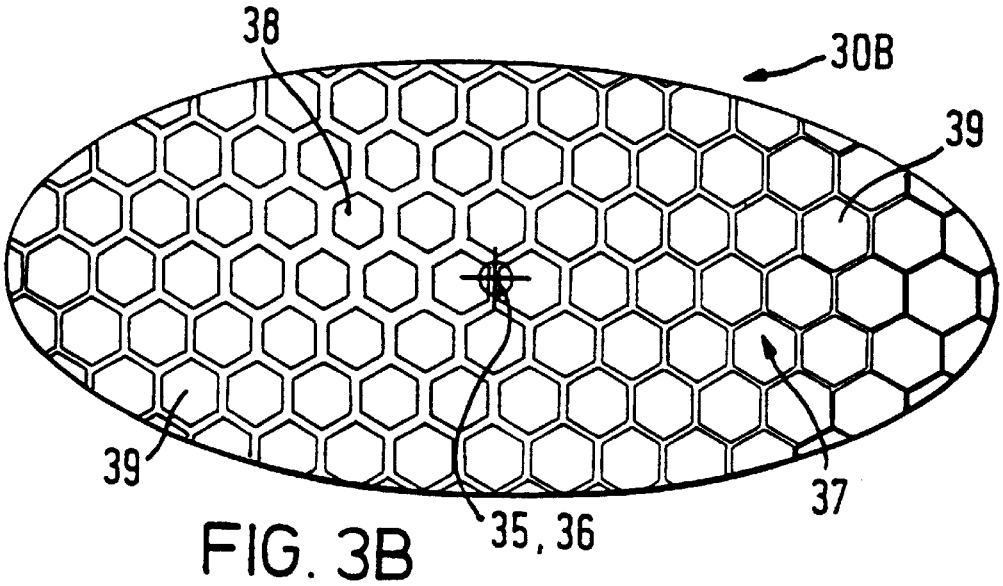
Figure 3C:
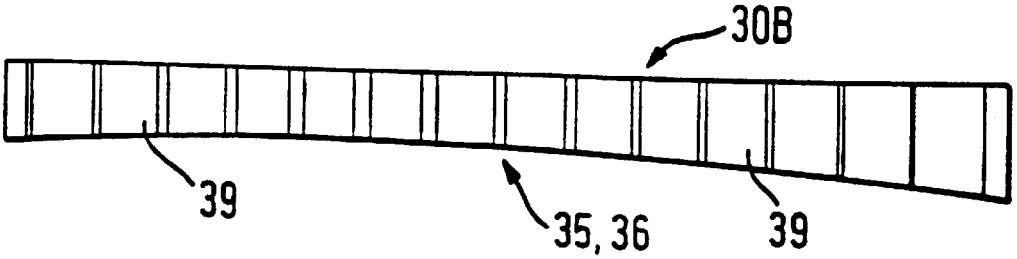

Turning to FIGS. 2A–C and 3A–C, all panel members are shown as being of generally elliptical shape, those referenced 20A, 30A being isotropic, thus showing coincidence at 25, 35 of geometrical centre and centre of mass. To the extent meaningful for isometric panel geometries and structures, distributions of stiffness will, of course, also be centred at 25, 35—whether as to "high centre" (stiffness as such) or as to "low centre" (softness or compliance). In addition, FIGS. 2A, 3A show at 26, 36 one preferentially good or best location (as in patent application 08/707012) for a bending wave action transducer and operative for desired resonant mode acoustic performance of the panel member 20A, 30A, say as or in a loudspeaker.

Turning to FIGS. 2B, C and 3B, C the centre positions of the panels 10B 20B, 30B are now labelled 25, 26 and 35, 36 and still correspond to both of geometric centre and centre of mass (25, 35), but now also further to acoustically effective bending wave transducer location (26, 36). Compared with FIGS. 2A, 3A the transducer locations 26, 36 have effectively been displaced by a distribution of bending stiffness(es), hereof, and accompanying displacements of "high and "low" centres of stiffness, are indicated 27, 28 and 37, 38 as generally oppositely relative to the geometric centres 25, 35. This different asymmetric stiffness distribution is shown achieved by progressive changes to cells 29, 39 particularly as to their heights, thus thickness of the panel members 20A, 30A; but also as to their areas and population density (see FIGS. 2B, C), or as to their areas and wall thicknesses but not their population density (see FIGS. 3B, C) thereby achieving desired distribution of stiffness without at least operatively significant disturbance to distribution of mass, thus centre of mass is now coincident with both geometric centre and transducer location (25, 26; 35, 36).

There are further feasible approaches to varying stiffness (es), thus areal distribution; say by introducing out-of-planar formations, such as bends, curves etc affecting stiffness in generally understood ways; or such as grooves, slots or scorings in surfaces to reduce stiffness or rib formations to increase stiffness, including progressively by spaced series of such provisions, say along the line extensions 15G, L of FIG. 1A (not shown, but computable using such as Finite Element Analysis).

Figure 4A:
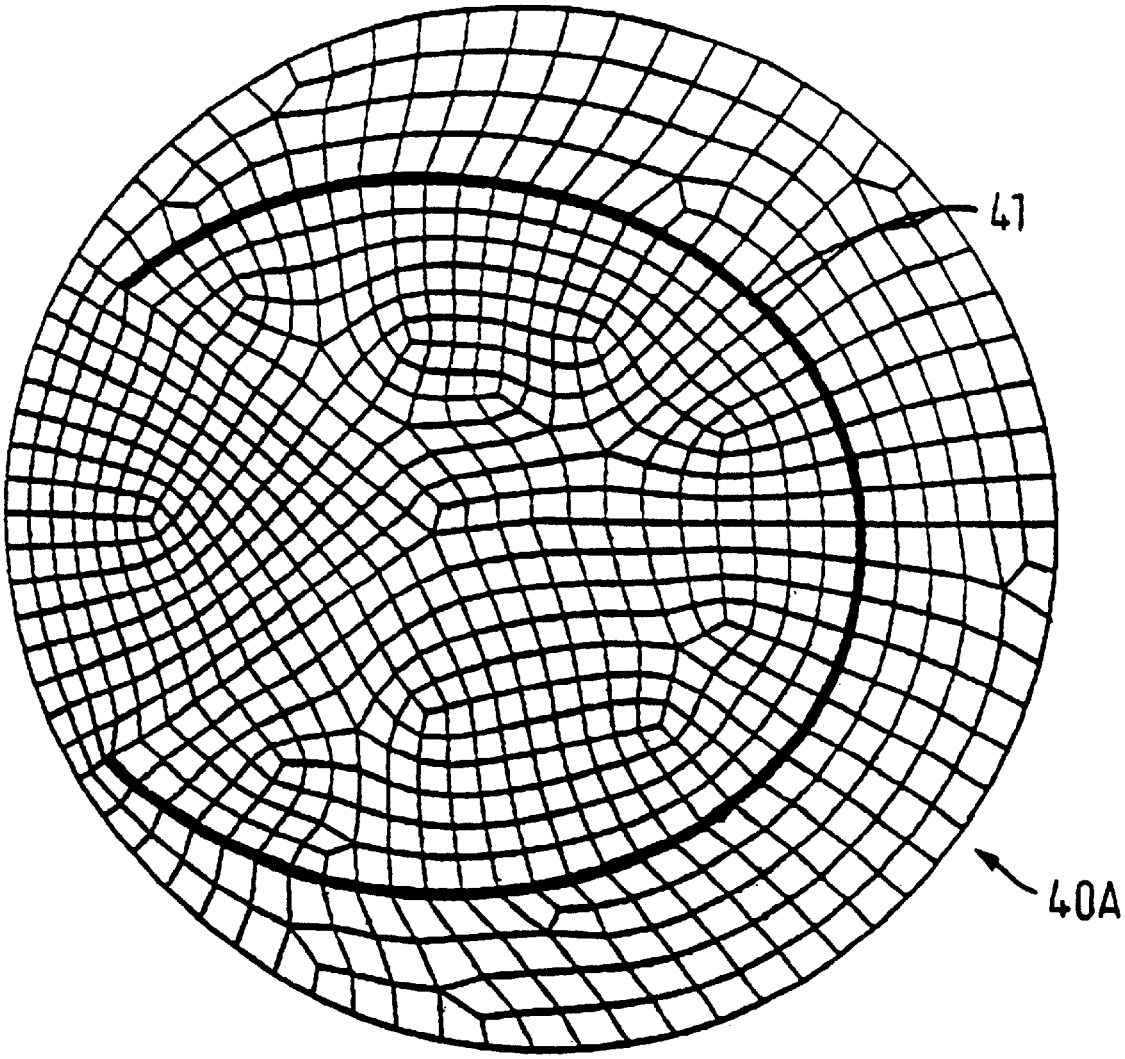
FIGS. 4A, B, C indicate a acoustic panel member of unfavourable circular shape rendered more favourable by part-elliptical grooving/slotting, and model distribution graphs without and with such grooving/slotting.
Figure 4B:
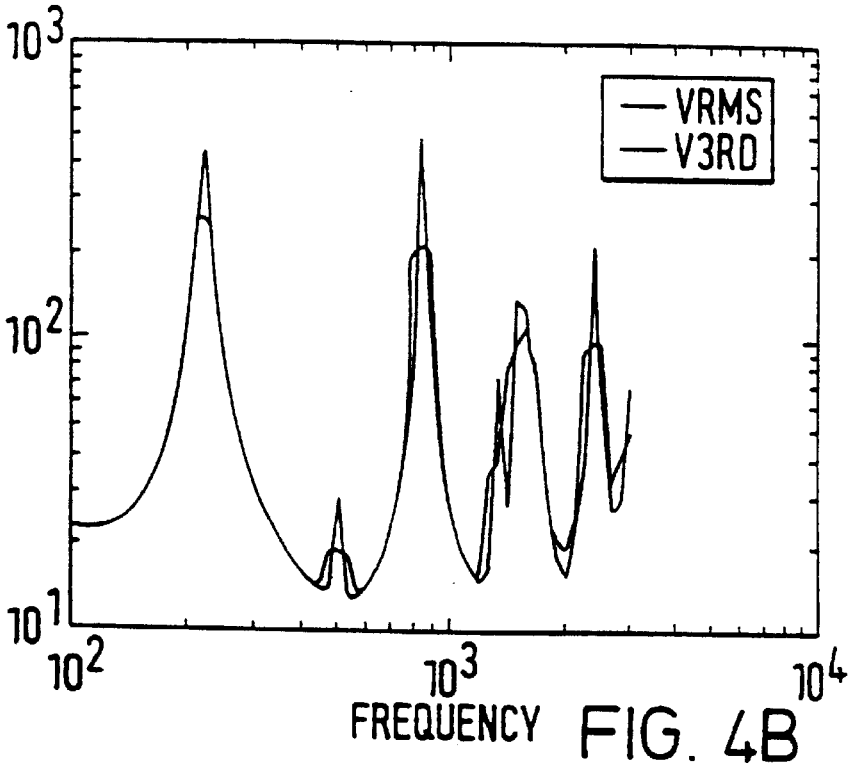
Figure 4C:
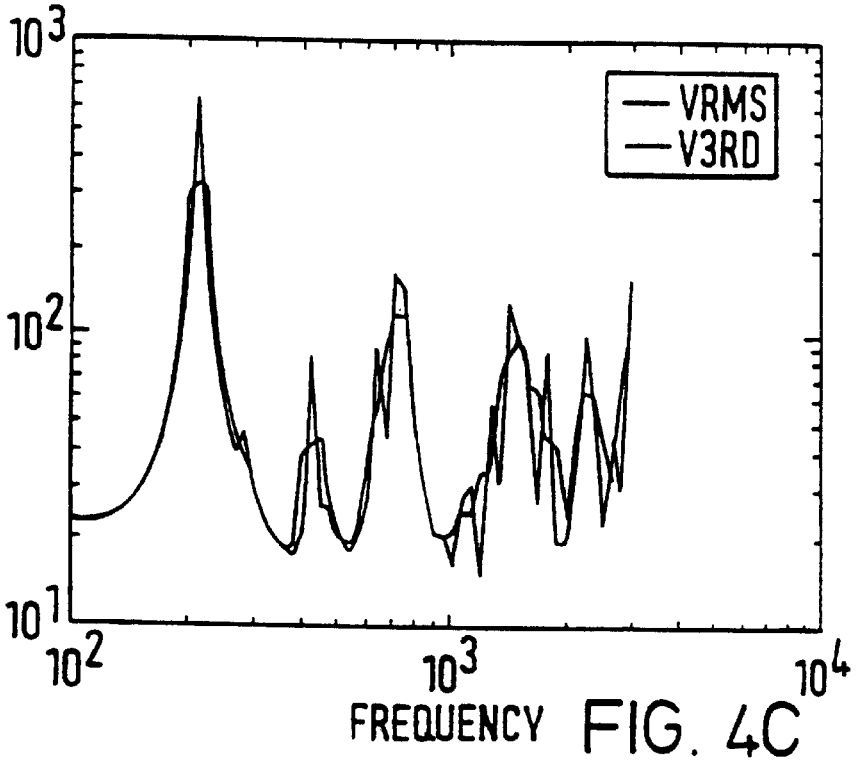

FIG. 4A shows another application of into-surface grooving, slotting or scoring, specifically to improving distributed mode bending wave action for an acoustic panel member 40 that is actually of a configuration or geometry, namely circular, that is known to be unfavourable as a distributed mode acoustic panel member, especially with central location of exciting transducer means. This known unsatisfactory performance capability is indicated by the modal frequency distribution indicated in FIG. 4B as will be readily recognised and understood by those skilled in the art, specifically corresponding to concentric vibration patterning. Profound improvement on what is shown in FIG. 4C has been achieved by grooving, slotting or scoring as indicated at 45 in the form of part of an ellipse, i.e. in a class of configurations/geometries known to include some highly favourable as distributed mode acoustic panel members (as in FIGS. 2, 3 above), though not actually according to such a known favourable particular ellipse. However, effect on lower frequency modal action is markedly better distributed than the symmetry of simple centrally excited circular shapes, and higher frequency modal action is able to extend past and beyond the open ends of the groove 45. The shape of the groove 45 was developed using Finite Element Analysis, see indicated complex element patterning, such techniques being of general value to detail implementation of teachings hereof. Lesser arcuate formations asymmetrically spaced relative to centre of a circular panel member have also shown promise, and should be readily refined by further Finite Element Analysis.

Figure 5A:
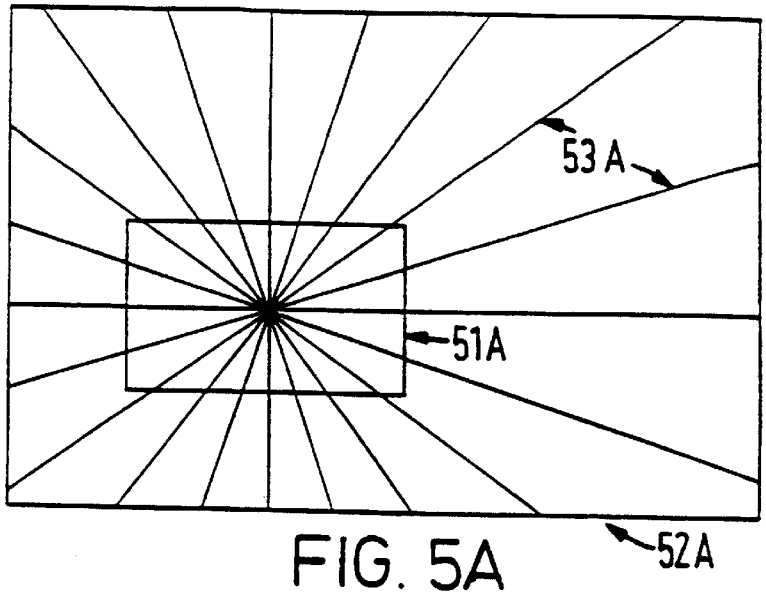
FIGS. 5A, B, C are diagrams useful in explaining possible mappings/constructs/transforms for deriving stiffness distribution for desired or target geometry for a rectangular panel member and a sectional/profile representation of results.
Figure 5B:
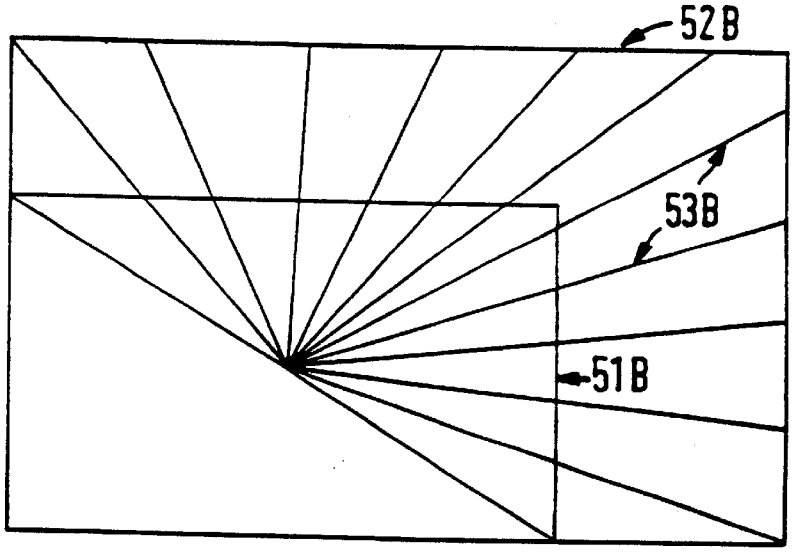
Figure 5C:
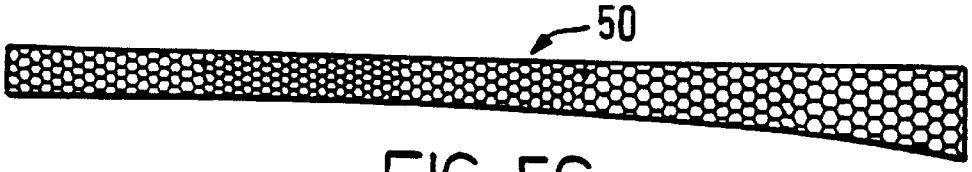

FIGS. 5A, B indicate constructs and transforms much as discussed above, specifically shown for rectangular target (51A, B) and subject (52A, B) configurations/geometries. Construct lines 53A, B processed according to different lengths and desired/required bending stiffnesses show highly promising effectiveness of the approach at least as applied to shapes of the same rectangular type. The methodology of FIG. 5B is particularly attractive in that the subject configuration/geometry 52B is efficiently constructed from the target configuration/geometry 51B placed at one corner by extensions from that corner so that a preferential transducer location 54B of a well-understood and analysed isometric shape 52B simply coincides with geometrical centre of the target shape 51B. FIG. 5C indicates a typical section through target member 50 of target shape 51A resulting from methodology according to FIG. 5B.

Inspection of the B/$\mu$ quotient or the B and/or $\mu$ parameter values, specifically alone with the other held constant, in the various radial directions 53B, and mathematical mapping from panel of shape 52B to panel of shape 51B, allows distribution of stiffness hereof to be computed in those directions (53B) further using a power Arelation including fourth power of length and second or third powers of thickness depending on whether bending stiffness required is of skinned core sandwich panel or an unskinned monolithic solid composite structure.

Figure 6A:
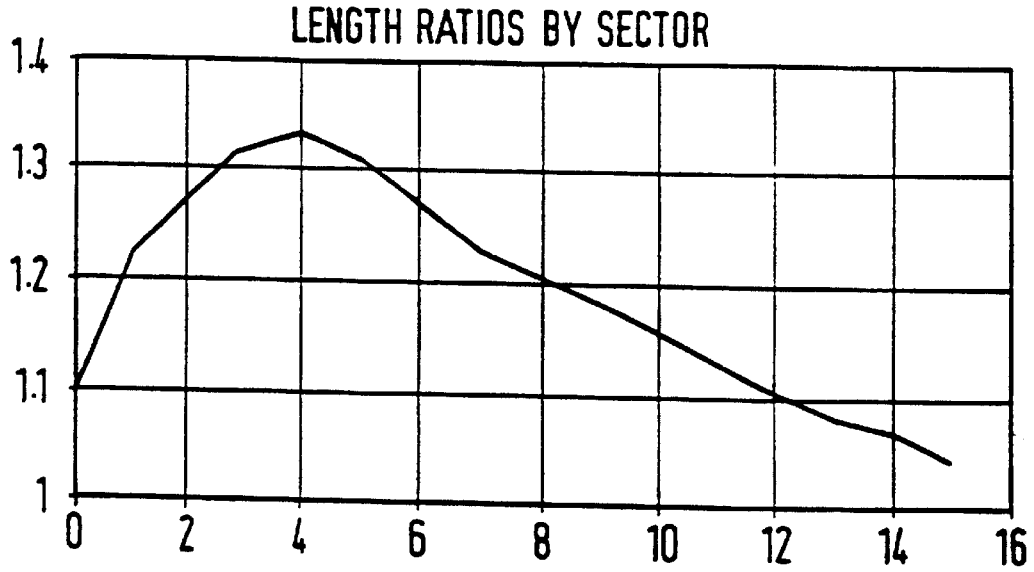
FIGS. 6A, B, C are outline graphs of interest relative to useful methodology including of FIG. 5.
Figure 6B:
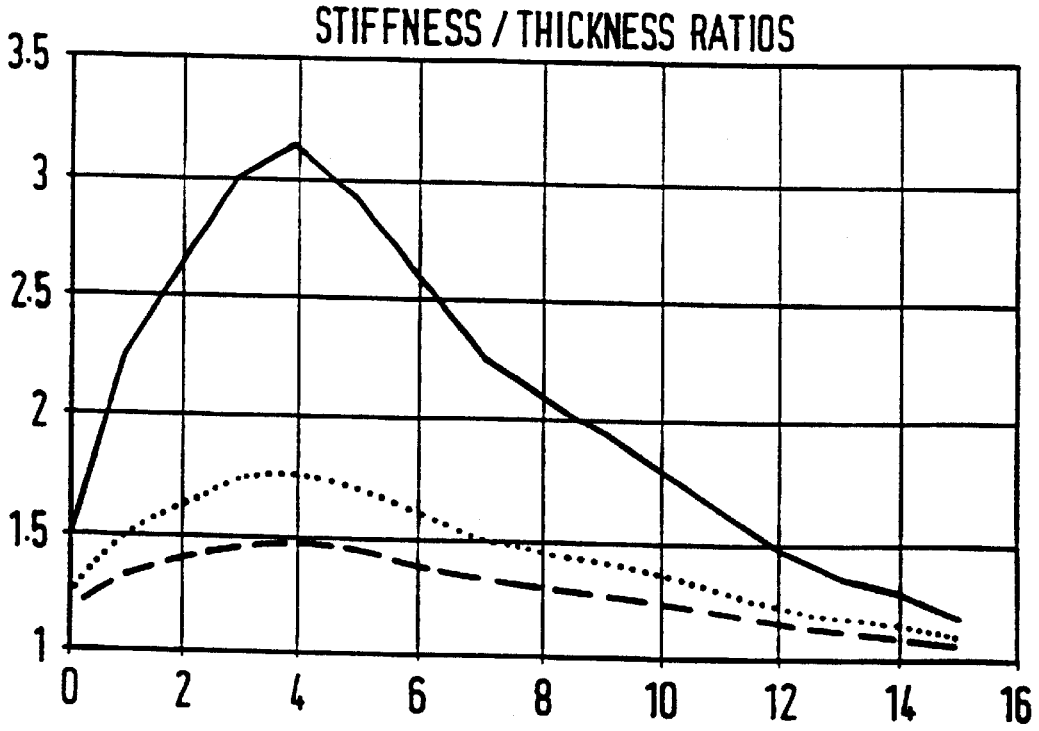
Figure 6C:
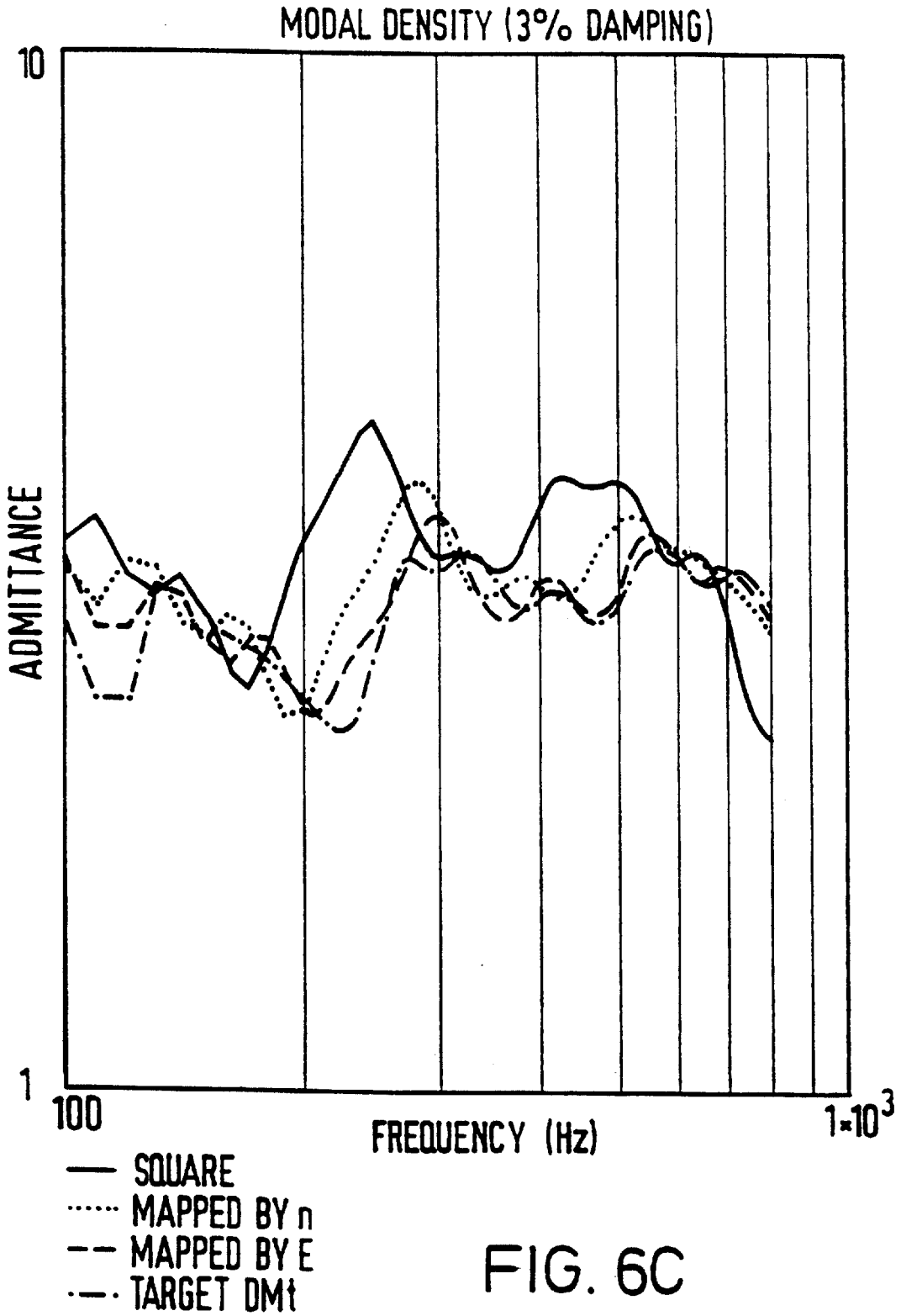

FIG. 6A shows ratiometric results of length mapping for FIG. 5B methodology, and FIG. 6B shows how required (target) bending behaviour is related to the ratiometric results of FIG. 6A and relative to material properties, specifically stiffness alone involving fourth power of length (solid line), thickness of a sandwich structure involving a square power (dotted line), and thickness of a monolith structure involving a 4/3 power (dashed line). For a sandwich structure, skin stiffness (tensile strength) would also involve fourth power of length; and skin thickness a 4/3 power. FIG. 6C shows modal density mapping with 3% damping for a target square panel member, without bending stiffness distribution hereof, a subject 1.134:1 aspect ratio isometric panel member of patent application Ser. No. 08/707012 involving adjustment relative to one side difference only; and the square panel improved by bending stiffness distribution according to skin parameters, specifically thickness (h) and Young's modulus (E).

Figure 7A:
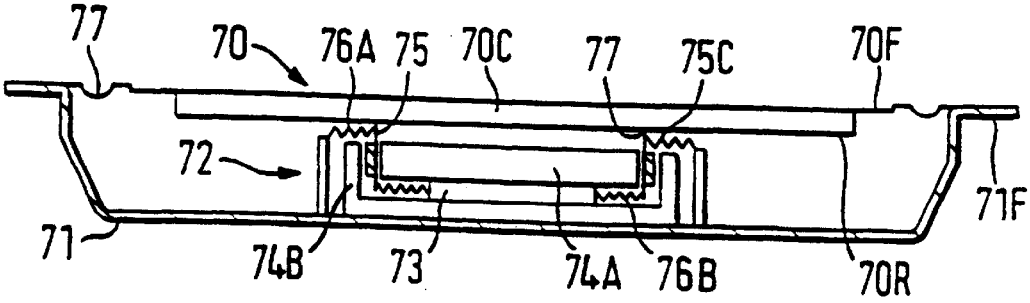
FIGS. 7A, B are sectional side and plan views of one embodiment of loudspeaker drive unit of the present invention.
Figure 7B:
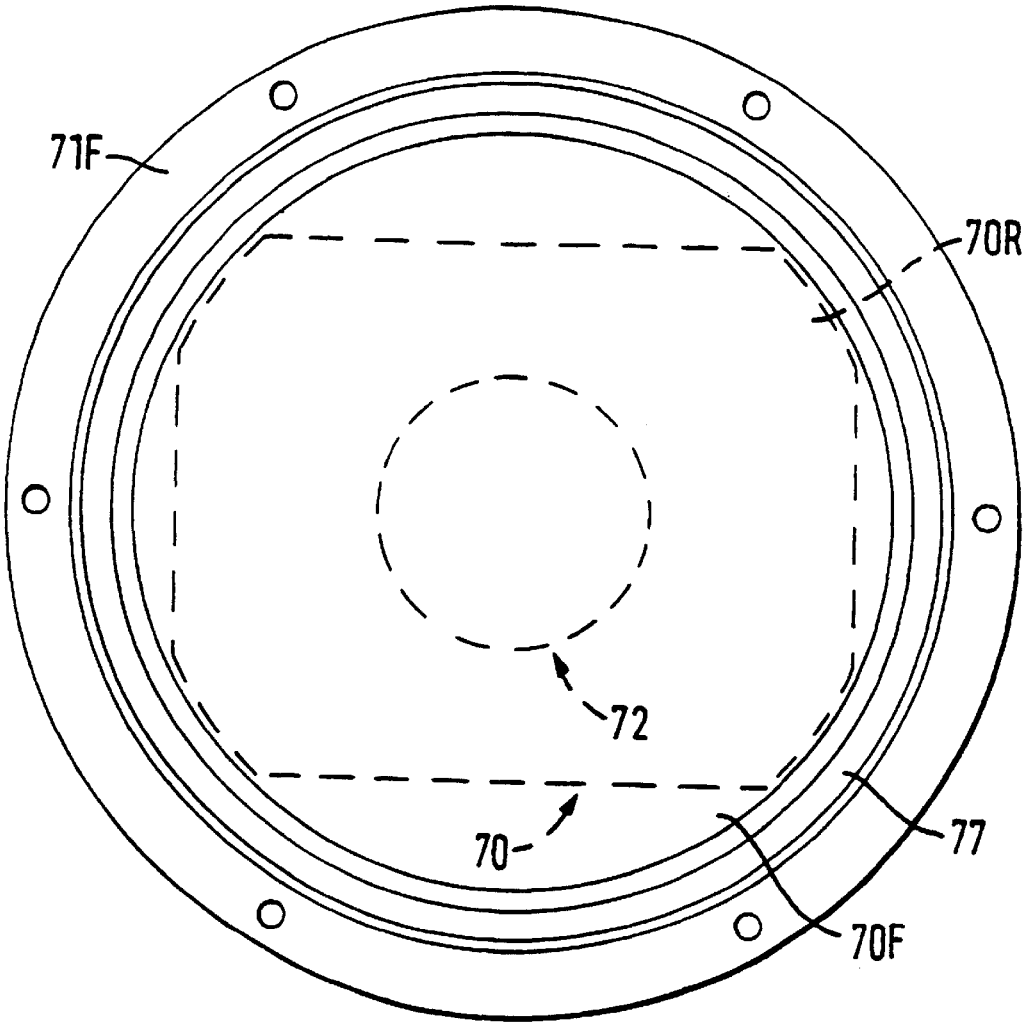

Referring to FIGS. 7A and 7B, a loudspeaker drive unit comprises a chassis 71 in the form of an open frame shaped as a shallow circular basket or dish having an outwardly projecting peripheral flange 71F pierced with holes whereby the drive unit can be mounted on a baffle (not shown), e.g. in a loudspeaker enclosure (not shown) in generally conventional fashion. The chassis 71 supports a transducer 72 in the form of an electrodynamic drive motor comprising a magnet 73 sandwiched between pole pieces 74A,B and affording an annular gap in which is mounted a tubular coil 75 former carrying a coil 75C which forms the drive coupling or actuating movable member of the motor.

The coil former is mounted on resilient suspensions 76A,B at its opposite ends to guide the coil former 75 for axial movement in the gap of the magnet assembly. One end of the coil former 75 is secured, e.g. by bonding 77, to the rear face of a lightweight rigid panel 70 which forms an acoustic radiator diaphragm of the loudspeaker drive unit and which comprises a lightweight cellular core 70C, e.g. of honeycomb material, sandwiched between opposed front and rear skins 70F,R. The panel 70 is generally as herein taught, specifically with distribution of bending stiffness affording coincidence of centre of mass and preferential bending wave exciter location at its geometric centre. In the example shown, the front skin is conveniently of conventional circular form integrating with the contour and in some cases blending in effective operation with the surround/suspension. The rear skin is chosen to be rectangular to form a composite panel compliant with distributed mode teaching (it may be driven directly by the differential coupler of FIGS. 10A and 10B).

For a simple central, or central equivalent drive the distributed mode panel section will be designed with preferential modal distribution as per the invention herein generated for example by control of areal stiffness, so as usefully to place the modal driving point or region at or close to the geometric and mass centre. Thus good modal drive at higher frequencies and pistonic operation at lower frequencies is obtained for a conventional style of driver build and geometry.

The front facing skin 70F of the panel 70 is extended beyond the edge of the panel and its peripheral margin is attached to a roll surround or suspension 77 supported by the chassis 71 whereby the panel is free to move pistonically. The transducer 72 is arranged to move the panel 70 pistonically at low frequencies and to vibrate the panel 70 at high frequencies to impart bending waves to the panel whereby it resonates as discussed at length above.

Figure 8A:
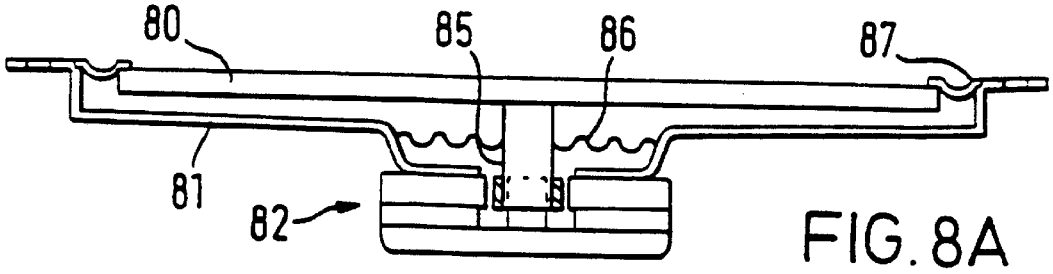
FIGS. 8A, B are sectional side views of another loudspeaker drive unit and a modification.
Figure 8B:
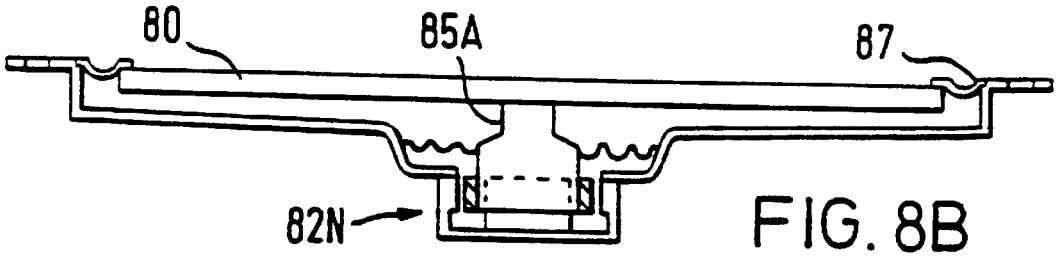

The arrangements shown in FIGS. 8A and 8B are generally similar to that described above, except that in these cases the chassis 81 is even shallower, the motor 72 is largely outside the chassis 81, and the coupler/actuator coil former 85 extends into the chassis with consequent modification of its suspension 86. Modification of FIG. 9B involves use of a smaller neodymium motor 82N and sectional end reduction 85A of the coil former 85.

Figure 9A:
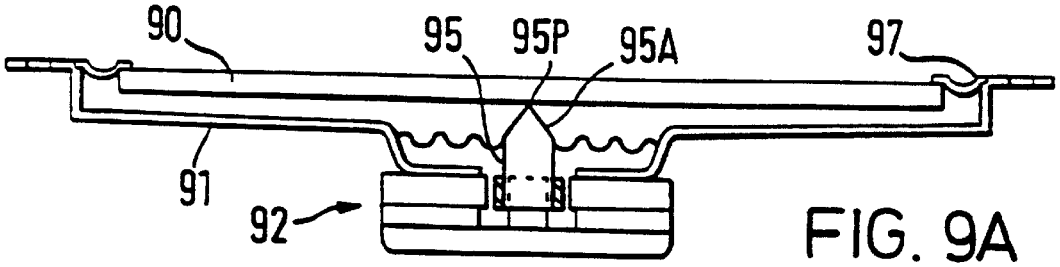
FIGS. 9A, B are sectional side view of a further loudspeaker drive unit and modification.
Figure 9B:
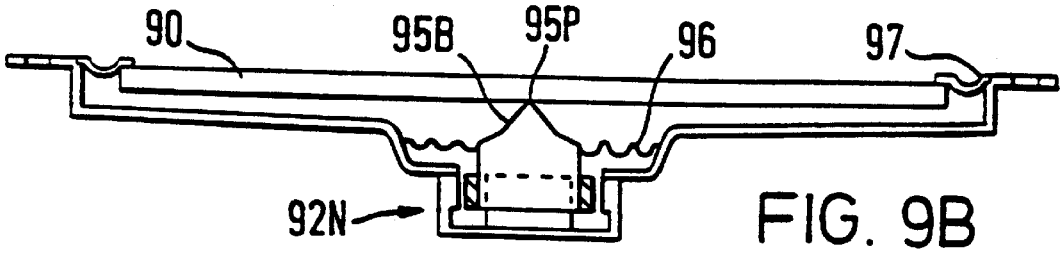

The arrangements shown in FIGS. 9A and 9B are very similar to those shown in FIG. 8A and 8B except that the extended end 95A,B of the coil former 95 is formed with a single or double conic section, the pointed end 95P of which is attached to the rear face of the lightweight rigid panel diaphragm 90 at the geometric centre thereof.

Figure 10A:
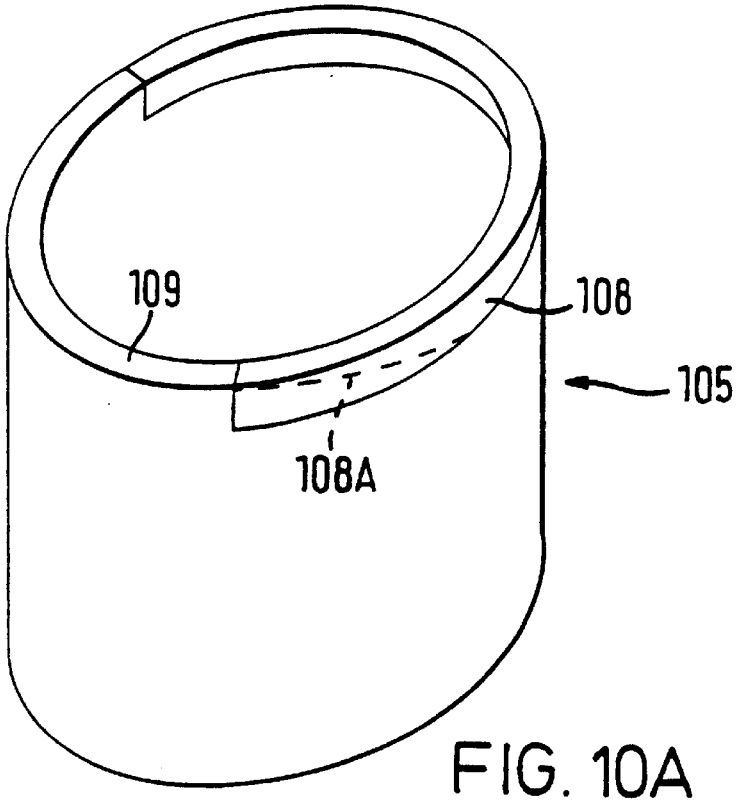
FIGS. 10A, B are a perspective view of a loudspeaker drive coupling or actuator for spaced application of pistonic and bending wave action, and detail of mounting to a diaphragm/panel member.
Figure 10B:
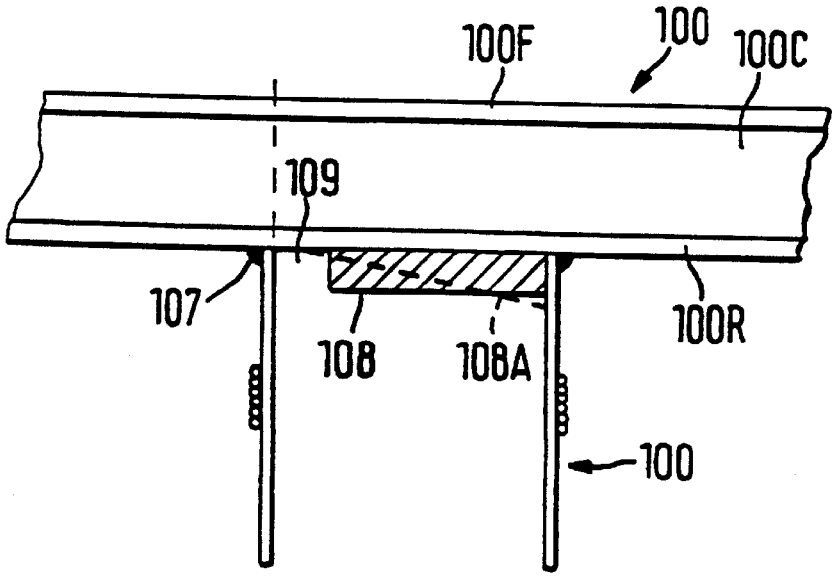

FIGS. 10A,B show a diaphragm coupler/actuator 100, conveniently a coil former of a drive motor (not shown), having a major arcuate peripheral part 108 of its drive end, which is adapted to be attached (107) to a rigid lightweight panel 100 made of a semi-compliant material; and with arcuate peripheral part 109 of the same end rigid. The drive applied to the panel 100 will be pistonic at low frequencies through both of the arcuate peripheral end parts 108,109. At high frequencies the coupler/actuator will excite bending wave action by the minor part 109, thus vibrational energy in the panel 100 at a position offset from the axis of the coupler/actuator 105. By its semi-compliant nature, the major arcuate peripheral end part 108 will be substantially quiescent at high frequencies. Thus the true actuation position of the drive is frequency dependent even though applied in the same way and by the same means 105.

The simple illustrated case of one direct coupling section and one semi compliant section may be extended to multiple firm contact points and more complex semi-compliant arrangements, e.g. two or more preferential distributed mode panel member transducer locations may be involved. The semi compliant section may be tapered or graded, or plurally stepped in thickness or bulk property, to provide a gradation of coupled stiffness interactively calculated with the panel acoustic performance criteria to improve overall performance, whether with a distributed mode acoustic panel with bending wave transducer location spaced from geometric/mass centre to suit convenient structure for the coupler/actuator 105, or with the latter suited to such as transducer locations of two prior patent applications.

Such differential frequency coupler (105) can be used with the usual motor coil employed in electrodynamic exciters. While such coupler 105 may be a separate component of predetermined size or diameter, it is convenient to see its application as part of the attachment plane of a motor coil of similar diameter, which may as indicated above be chosen to encompass one or more of the preferential drive transducer locations of a distributed mode acoustic panel member, specifically at and excited by rigid end part(s) 108 as intended higher frequency response is by bending mode vibration in a distributed mode acoustic panel diaphragm member 100. At lower frequencies the semi-resilient parts/inserts 108 become more contributory, and progressively bring the whole circumference of the actuator/coupler 105 into effect for balanced, centre of mass action, thus satisfactory pistonic operation at low frequencies. The fundamental bending frequency of the panel member 100 and the resilience of the coupler/actuator part(s) 108 are chosen to allow for satisfactorily smooth transition in acoustic power from the pistonic to the bending vibration regions of the frequency range. Such transition may be further aided by plural stepping of the part(s) 108, or by tapering as indicated at 108A.

Figure 11A:
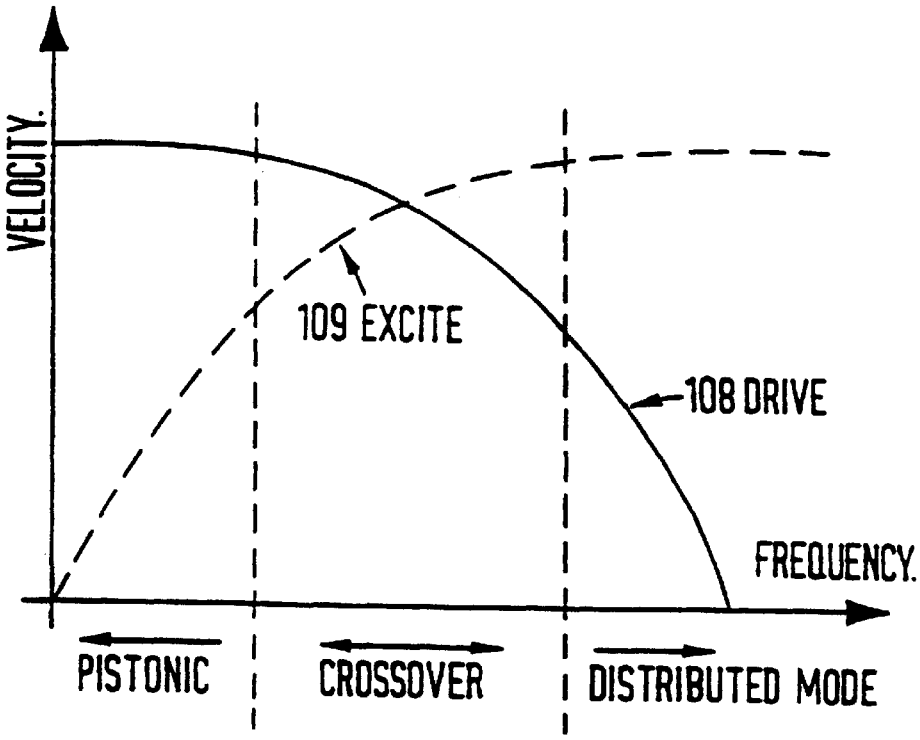
FIGS. 11A, B show relationships for such actions and crossover.

Understanding operation of this coupler 108 is aided by FIG. 11A outlining intended variation of velocity applied to the acoustic panel, including in the region of crossover. At low frequencies the semi compliant part(s) 108 contribute effective power to the panel member 100 in a balanced pistonic manner. That piston like action decays with increasing frequency as the mechanical impedance of the vibrating panel member 100 becomes predominant and is excited at preferential eccentric position(s). Thus the active velocity contribution at higher frequencies arises from the rigid, offset sector(s) of the coupler.

Figure 11B:
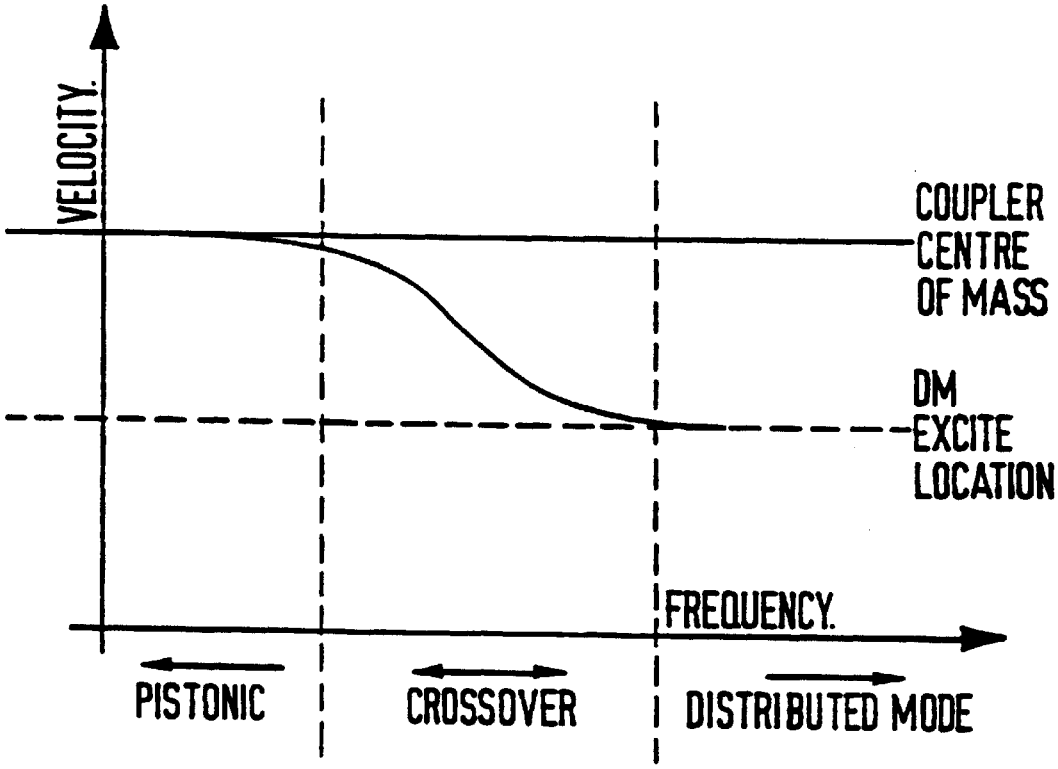

FIG. 11B further shows displacement of effective variation of pistonic drive and distributed mode excitation points with frequency. At low frequencies the pistonic drive point is predominantly at the centre and centre of mass. With increasing frequency there is a transition to a bending wave excitation point offset from the centre, aligned by suitable choice of panel design and also complex coupler actuator diameter and parts geometry to drive at or close to the preferred distributed mode point for satisfactory favourable distribution of vibration modes.

In above FIGS. 7A,B bending wave transducer means of this type with an overall diameter in the range 150 to 200 mm would operate "natural" transducer location(s) of a distributed mode panel member of satisfactory bending mode performance commencing in the range 150 Hz to 500 Hz. Pistonic operation will be effective from lower frequencies, eg from 30 Hz for a suitable acoustic mounting, and would decline in its upper range as the panel member enters the bending mode range.

The differential frequency capability of couplers of this invention allows subtle refinements to use of distributed mode acoustic panel members. For example, in a given panel a change in the driving point with frequency may be found desirable for purposes of frequency control seen in particular applications, such as close to wall mounting in small enclosures and related response modifying environments. More than one grade and/or size/area of semi-compliant parts or inserts may be used on suitable geometries of coupler effectively to gradually or step-wise move between more or most effective drive point of the modal pattern with frequency, and advantageously modify the radiated sound.

What is claimed is:

1. Acoustic device including a member extending transversely of its thickness and capable of sustaining bending waves causing consequential acoustic action by reason of areal distribution of resonant modes of natural bending wave vibration over its surface consonant with required achievable acoustic action of said member over a desired operative acoustic frequency range, wherein the member has a distribution of bending stiffness which varies over the area of the member for rendering said member more favourable to said areal distribution of resonant modes for said acoustic action, and the centre of bending stiffness of the member is offset from the geometric centre of the member, wherein the member is of a structure having a skin and the bending stiffness variation is by varying parameter(s) of the skin, and wherein the Young's modulus of the skin is one of said parameter(s).

2. A loudspeaker comprising a chassis, a transducer supported on the chassis, a stiff lightweight panel diaphragm to drivingly coupled to the transducer, and a resilient edge suspension surrounding the diaphragm and mounting the diaphragm in the chassis, wherein the diaphragm extends transversely of its thickness and is capable of sustaining bending waves causing consequential acoustic action by reason of areal distribution of resonant modes of natural bending wave vibration over its surface consonant with required achievable acoustic action of said diaphragm over a desired operative acoustic frequency range, wherein the diaphragm has a distribution of bending stiffness which varies over the area of the diaphragm for rendering said diaphragm more favourable to said areal distribution of resonant modes for said acoustic action, wherein the centre of bending stiffness of the diaphragm is offset from the geometric centre of the member, and wherein the transducer is arranged to drive the diaphragm pistonically at relatively low audio frequencies to produce an audio output and to vibrate the diaphragm with bending waves at higher audio frequencies to cause the diaphragm to resonate to produce an audio output, the transducer being operatively coupled at the centre of mass of the diaphragm.

3. The loudspeaker according to claim 2, wherein the diaphragm is circular in shape.

4. The loudspeaker according to claim 2 or claim 3, wherein the diaphragm comprises a lightweight cellular core sandwiched between opposed skins.

5. The loudspeaker according to claim 4, wherein one of the skins is extended beyond an edge of the diaphragm, a marginal portion of the extended skin being attached to the resilient suspension.

6. The loudspeaker according to claim 2, wherein the diaphragm is a distributed mode resonant panel.

7. The loudspeaker according to claim 2 or claim 6, wherein the transducer is electromagnetic and comprises a moving coil mounted on a coil former, the coil former being operatively coupled to the diaphragm.

8. The loudspeaker according to claim 7, comprising a second resilient suspension connected between the coil former and the chassis.

9. The loudspeaker according to claim 8, wherein one end of the coil former is connected to the diaphragm, said second resilient suspension is disposed adjacent to the said one end of the coil former, and a third resilient suspension is connected between the other end of the coil former and the chassis.

10. The loudspeaker according to claim 7, wherein the end of the coil former adjacent to the panel diaphragm is coupled to drive the panel diaphragm substantially at one point.

11. The loudspeaker drive unit according to claim 10, comprising a conical link connected between the coil former and the panel diaphragm.

12. A loudspeaker comprising a chassis, a transducer supported on the chassis, a stiff lightweight panel diaphragm drivingly coupled to the transducer, and a resilient edge suspension surrounding the diaphragm and mounting the diaphragm in the chassis, wherein the diaphragm extends transversely of its thickness and is capable of sustaining bending waves causing consequential acoustic action by reason of areal distribution of resonant modes of natural bending wave vibration over its surface consonant with required achievable acoustic action of said diaphragm over a desired operative acoustic frequency range, wherein the diaphragm has a distribution of bending stiffness which varies over the area of the diaphragm for rendering said diaphragm more favourable to said area1 distribution of resonant modes for said acoustic action, wherein the centre of bending stiffness of the diaphragm is offset from the geometric centre of the member, and wherein the transducer is arranged to drive the diaphragm pistonically at relatively low audio frequencies to produce an audio output and to vibrate the diaphragm with bending waves at higher audio frequencies to cause the diaphragm to resonate to produce an audio output, the transducer being operatively coupled at the geometric centre of the diaphragm.

13. The loudspeaker according to claim 2, wherein the diaphragm is elliptical in shape.

14. Acoustic device according to claim 1, wherein the centre of mass of the member is located at its geometric centre.

15. Acoustic device according to claim 14 wherein said variation of bending stiffness includes relatively higher and lower bending stiffness at different sides, respectively, of a location for a bending wave transducer.

16. Acoustic device according to claim 14, wherein said variation of bending stiffness includes relatively higher and lower bending stiffness at different sides, respectively, of the geometric centre of said member.

* * * * *